United States Patent [19]

Doll et al.

[11] Patent Number: 5,039,652

[45] **Date of Patent: * Aug. 13, 1991**

[54] CLEAN RELEASE POSTAL CARD OR MAILER

[75] Inventors: Gary Doll, Englewood, Ohio; William T. Paulson, Big Pine Key, Fla.; William F. Pinell, Lebanon, Ohio

[73] Assignee: The Standard Register Company, Dayton, Ohio

[ * ] Notice: The portion of the term of this patent subsequent to May 23, 2006 has been disclaimed.

[21] Appl. No.: 346,716

[22] Filed: May 3, 1989

Related U.S. Application Data

[63] Continuation-in-part of Ser. No. 68,837, Jul. 1, 1987, Pat. No. 4,833,122.

[51] Int. Cl.[5] ..... B41M 5/165; B42D 15/02; B65D 27/00

[52] U.S. Cl. ..... 503/206; 229/68 R; 229/92.8; 428/195; 428/321.5; 428/914; 503/215; 503/226

[58] Field of Search ..... 428/321.5, 195, 914; 503/206, 215, 226; 229/68 R, 92.8

[56] References Cited

U.S. PATENT DOCUMENTS

| | | | |
|---|---|---|---|
| 89,507 | 4/1869 | Saladee . | |
| 709,805 | 9/1902 | Stearns et al. . | |
| 2,666,655 | 1/1954 | Wolowitz | 282/2 S |
| 3,126,211 | 4/1959 | Hieken et al. | 283/6 |
| 3,261,623 | 7/1966 | Kiedrowski | 282/2 S |
| 3,329,333 | 4/1965 | Ormond | 229/92 S |
| 3,713,238 | 1/1973 | Hyman et al. | 40/158 |
| 4,172,605 | 10/1979 | Welsch et al. | 428/199 |
| 4,278,199 | 7/1981 | Tanaka | 229/92.8 |
| 4,729,506 | 3/1988 | Neubauer | 229/69 |
| 4,742,954 | 5/1988 | Shishido | 229/92.8 |
| 4,817,989 | 4/1989 | Pendergast | 282/9 R |
| 4,824,142 | 4/1989 | Dossche | 282/11.5 A |
| 4,833,122 | 5/1989 | Doll et al. | 503/226 |

FOREIGN PATENT DOCUMENTS

| | | | |
|---|---|---|---|
| 0064485 | 4/1986 | Japan | 428/321.5 |

*Primary Examiner*—Bruce H. Hess

*Attorney, Agent, or Firm*—Killworth, Gottman, Hagan & Schaeff

[57] ABSTRACT

A postal card or mailer construction comprising a cover sheet adhered to a base sheet is provided which is simple to manufacture and print by automated systems and which is capable of providing hidden confidential information to an addressee. Upon receipt, the addressee can readily peel back the cover sheet and read the confidential information. Through the use of a releasable adhesive, once delaminated, all surfaces of the postal card construction have nontacky surfaces, permitting easy handling and storage by the recipient. The construction includes a base sheet, a cover sheet overlying the base sheet, and a releasable adhesive securing a first surface of the cover sheet to a first surface of the base sheet such that the cover sheet and base sheet are readily separable. The releasable adhesive contains therein a first color former composition which, when exposed to a second color developer composition, forms a distinctive color. At least oen of the first and second compositions are contained in a plurality of capsules which rupture upon the application of an impact force on the cover sheet. When an imaging force is applied to the cover sheet, the capsules of the first composition are ruptured, mix with the second composition on the surface of the base sheet, and form a distinctive color to duplicate the information from the imaging force.

32 Claims, 4 Drawing Sheets

CLEAN RELEASE POSTAL CARD OR MAILER

CROSS-REFERENCE TO RELATED APPLICATION

This application is a continuation-in-part of commonly assigned U.S. application Ser. No. 068,837, filed July 1, 1987, now U.S. Pat. No. 4,833,122, and entitled IMAGABLE CLEAN RELEASE LAMINATE CONSTRUCTION.

BACKGROUND OF THE INVENTION

This invention relates to a clean release postal card or mailer and a continuous form for preparing a series of postal cards or mailers, and in particular to a construction in which a releasable adhesive secures together a base sheet and a cover sheet which obscures confidential information printed on the base sheet until opened by the addressee. The base sheet can be imaged through the use of chemical carbonless techniques.

Many types of confidential information are transmitted through the mails in the form of messages, invoices, notices of bank account balances and/or interest income for tax purposes, and the like. Previously, where information was desired to remain hidden until received by the addressee, envelopes were used. Post cards, on the other hand, are useful for delivering short messages, are less expensive to mail, and are relatively simple to be printed by automated equipment. However, post cards have not been suitable in the past for the delivery of confidential information because the printed message was easily read by persons other than the addressee.

More recently, attempts have been made to produce post card constructions which permit the obscuring of confidential information until receipt by the addressee. For example, Tanaka, U.S. Pat. No. 4,278,199, teaches a post card construction in which confidential information is preprinted on the card, and then an opaque cover member which is substantially smaller in size than the card is adhered to the card, covering the confidential information. In one disclosed embodiment, Tanaka teaches adhering the cover member, as well as means for transferring impressions entered on the cover member, such as a sheet of carbon paper or a carbon spot, to the card prior to printing, and then imprinting the confidential information through the cover member to the card.

Shishido, U.S. Pat. No. 4,742,954, also teaches a post card construction in which preprinted confidential information may be hidden from view by a laminated cover sheet which is secured to a transparent protection film layer bonded to a base sheet. The cover sheet is delaminated from the base sheet by the addressee of the post card to reveal the confidential information.

However, both Shishido and Tanaka suffer from shortcomings which render them as less than perfect solutions to the long-standing problem of finding a simple postal card construction capable of containing hidden confidential information. The laminate construction of Shishido requires the interposition of both a clear protection film and a coupling layer between the cover member and base sheet. This coupling layer must be laminated by a heating operation within a closely controlled temperature range. Further, Shishido appears to require at least two separate printing operations, once to print the confidential information on the base sheet and again to provide addressee information on the top of the cover member.

Tanaka requires the careful placement of a small cover over preprinted confidential information. In an alternative embodiment, the cover and a separate sheet of an impression transfer means must be correctly positioned over an area to be printed. Additionally, the adhesive of Tanaka is permanent, requiring the additional operations of providing perforations or tear strips in order for the recipient of the card to be able to readily remove the cover member. Further, neither Shishido nor Tanaka describe a procedure for automating the production of a series of postal cards.

Accordingly, the need still exists in the art for a simple post card or mailer construction which is capable of providing hidden confidential information to an addressee. Further, there remains a need for such a construction which can be used in an automated system for the production of a series of such postal cards or mailers.

SUMMARY OF THE INVENTION

The present invention meets that need by providing a postal card or mailer construction comprising a cover sheet adhered to a base sheet which is simple to manufacture and print by automated systems and which is capable of providing hidden confidential information to an addressee. Upon receipt, the addressee can readily peel back the cover sheet and read the confidential information. Through the use of a releasable adhesive, once delaminated, all surfaces of the postal card or mailer construction have nontacky surfaces, permitting easy handling and storage by the recipient.

In accordance with one aspect of the present invention, a postal card or mailer construction comprising a base sheet, a cover sheet overlying the base sheet, and a releasable adhesive securing a first surface of the cover sheet to a first surface of the base sheet such that the cover sheet and base sheet are readily separable is provided. Preferably, the cover sheet and base sheet are of the same size, and the releasable adhesive covers substantially the entire surface between the two surfaces. However, it is within the scope of the invention that the cover sheet and base sheet are of different sizes and that the releasable adhesive is applied only to portions of the interface between the two surfaces. For example, the releasable adhesive may be applied only around the peripheral edges of the construction, or may be applied in a plurality of stripes across the two surfaces.

As used herein, the terms releasable adhesive and fugitive adhesive are used interchangeably and refer to the class of adhesives which form weak cohesive bonds between the surfaces they contact so that bond failure occurs either by cohesive failure within the adhesive layer itself or by adhesive failure at the interface between the adhesive layer and one of the surfaces it contacts. The releasable adhesives are nontacky to the touch when dry.

The releasable adhesive contains therein a first color former composition which, when exposed to a second color developer composition, forms a distinctive color. Such color former and color developer compositions are known in the art. At least one of the first and second compositions are contained in a plurality of capsules which rupture upon the application of an impact force on the cover sheet. Preferably, a plurality of capsules of the first composition are mixed with the releasable adhesive prior to application.

The base sheet has coated on the first surface thereof the second composition prior to lamination with the cover sheet. When an imaging force is applied to the cover sheet, as for example by a computer-controlled dot matrix printer, the capsules of the first composition are ruptured, mix with the second composition on the surface of the base sheet, and form a distinctive color to duplicate the information from the imaging force.

In a preferred form, a corner of the cover sheet or the base sheet is die cut to enable the recipient of the postal card or mailer to readily peel the cover sheet from the base sheet. Alternatively, a corner of the cover sheet or the base sheet may be removed during manufacture. Finally, an edge or corner of the construction may be left free of adhesive to provide a free-lifting edge for a user to grasp.

To insure that confidential information printed on the base sheet remains hidden from view, the material used for the cover sheet, as well as the base sheet, should be opaque. To assist in insuring opacity of the construction, block-out or camouflage images may be preprinted on the upper or lower surface of the cover sheet or on the lower surface of the base sheet. Alternatively, either or both of the cover sheet and base sheet may be made to have a high degree of opacity by having been coated with highly pigmented materials, by vacuum deposition of metals, or by any other suitable opacifying treatment.

In another embodiment of the invention, a postal card or mailer construction is provided which includes a base sheet having on a first surface thereof a first color former composition and a second color developer composition which, when combined, form a distinctive color. At least one of the first and second compositions are contained in a plurality of capsules which rupture upon the application of an imaging force. A cover sheet overlies the base sheet, and a releasable adhesive secures a first surface of the cover sheet to a first surface of the base sheet such that the cover sheet and base sheet are readily separable.

In yet another embodiment of the invention, a postal card or mailer construction is provided which includes a base sheet having on a second surface thereof a first color developer composition which, when combined with a first color former composition, forms a distinctive color. A cover sheet is also provided and has on a first surface thereof the first composition. The second composition is contained in a plurality of capsules which rupture upon the application of ar imaging force. A releasable adhesive secures the first surface of the base sheet to the first surface of the cover sheet, with the releasable adhesive being permeable to at least the first composition such that when an imaging force is applied, the first color former composition migrates to combine with the second color developer composition on the base sheet in the area of the imaging force.

In yet a further embodiment of the invention, a postal card or mailer construction is provided which includes a base sheet having on a first surface thereof a first color former composition and a second color developer composition which, when combined, form a distinctive color. At least one of the first and second compositions is contained in a plurality of capsules which rupture upon the application of an imaging force. A cover sheet overlies the base sheet and has a cut out window area corresponding to the portion of the base sheet in which addressee information is to be printed. A releasable adhesive secures a first surface of the cover sheet to a first surface of the base sheet such that the cover sheet and base sheet are readily separable.

In yet another embodiment of the invention, a postal card or mailer construction is provided which includes a cover sheet and a base sheet having on a first surface thereof a layer of colored dye particles. A releasable adhesive secures the first surface of the base sheet to the first surface of the cover sheet. The releasable adhesive also includes a plurality of microcapsules containing a solvent for the dye particles. Upon the application of an imaging force which ruptures the microcapsules, solvent is released and interacts with the dye particles to form a distinctive color in the imaging area.

In a further embodiment of the invention, a postal card or mailer construction is provided which includes a cover sheet, a base sheet, and a releasable adhesive which secures the base sheet to the cover sheet. The releasable adhesive includes a blend of solvent-containing microcapsules and colored dye particles. Upon the impact of an imaging force, the microcapsules release solvent which dissolves the dye particles to form a distinctive color in the area of the imaging force.

The postal card or mailer construction of the present invention may be produced from continuous webs of material to facilitate printing and handling by automated equipment. In one embodiment, continuous webs are combined to produce a series of postal card constructions which include a single ply web and a composite web collated together. The single ply web includes on the lower surface thereof a first color former composition. The composite ply web includes a base sheet, a cover sheet overlying the base sheet, and a releasable adhesive securing a first surface of the cover sheet to a first surface of the base sheet such that the cover sheet and base sheet are readily separable. The opposite surface of the cover sheet adjacent the lower surface of the single ply web contains a first color developer composition in an area of the cover sheet which is to contain imprinted address information. The releasable adhesive contains therein a second color former composition which, when exposed to a second color developer composition, forms a distinctive color. At least one of the first and second compositions is contained in a plurality of capsules which rupture upon the application of an imaging force on the cover sheet. The base sheet has on the first surface thereof the second composition.

The continuous form preferably includes a series of perforations along the length of and/or across the composite ply web which form individual ones of the postal cards. The color former composition on the lower surface of the single ply web may cover the entire surface of the web or be contained in areas corresponding to those portions of the form where address information is to be imprinted. The upper surface of the single ply web may include an area corresponding to the area where address information is to be printed which is coated with both a color former and a color developer composition which, when exposed to each other, form a distinctive color. At least one of the color former and color developer compositions is contained in a plurality of capsules which rupture upon the application of an imaging force on the single ply web.

In another embodiment of the invention, a continuous form for producing a series of postal card or mailer constructions is provided which includes a single ply web and a composite web collated together. The single ply web includes on the lower surface thereof means for transferring impressions entered onto the upper surface of the single ply web to the upper surface of the composite ply web. The impression transfer means may be a carbon imaging spot, a carbon tissue, or other suitable means. The composite ply web includes a base sheet, a cover sheet overlying the base sheet, and a releasable adhesive securing a first surface of the cover sheet to a first surface of the base sheet such that the cover sheet and base sheet are readily separable. The releasable adhesive contains therein a first color former composition which, when exposed to a second color developer composition, forms a distinctive color. At least one of the first and second compositions is contained in a plurality of capsules which rupture upon the application of an imaging force on the cover sheet, and the base sheet has on the first surface thereof the second composition.

In another embodiment of the invention, a continuous form for producing a series of postal card or mailer instructions is provided which includes a single ply web and a composite web collated together. In this embodiment, the composite ply web includes a base sheet having a layer of colored dye particles on the first surface thereof, a cover sheet overlying the base sheet, and a releasable adhesive securing a first surface of the cover sheet to a first surface of the base sheet such that the cover sheet and base sheet are readily separable. The releasable adhesive includes a plurality of solvent-containing microcapsules which rupture upon application of an imaging force, causing the dye particles to dissolve and form a distinctive color in the area of the imaging force.

In another embodiment of the invention, a continuous form for producing a series of postal card or mailer constructions is provided which also includes a single ply web and a composite web collated together. The composite ply web of this embodiment includes a base sheet, a cover sheet overlying the base sheet, and a releasable adhesive securing a first surface of the cover sheet to a first surface of the base sheet such that the cover sheet and base sheet are readily separable. The releasable adhesive includes a blend of solvent-containing microcapsules along with colored dye particles. Upon the impact of an imaging force, the microcapsules rupture to release solvent which dissolves the dye particles and form a distinctive color in the area of the imaging force.

In practice, the postal card or mailer construction of the present invention may be produced by preprinting repetitive images such as standard messages, instructions, or other information and applying suitable coatings of color former and color developer compositions to continuous webs of the cover sheet and base sheet material which are used. Camouflage images and suitable opacifying coatings may also be preprinted at this time. The images may be printed on the upper and/or lower surfaces of each of the webs as desired. The individual webs are then laminated together to form a continuous composite web using a releasable adhesive.

The continuous composite web is then preferably collated with one or more single ply webs and provided with feed holes in the margins and perforations along the length of and/or across the webs to identify individual postal cards. These collated continuous forms may then be folded into packs or burst into individual units. A preferred method of preparation is to leave the webs in a continuous form folded in packages and imprint them with address and confidential information using an automated printing system.

Accordingly, it is an object of the present invention to provide a postal card or mailer construction including a cover sheet adhered to a base sheet which is simple to manufacture and print by automated systems and which is capable of providing hidden confidential information to an addressee. This, and other objects and advantages of the present invention, will become apparent from the following detailed description, the accompanying drawings, and the appended claims.

DESCRIPTION OF THE PREFERRED EMBODIMENTS

Figure 1:
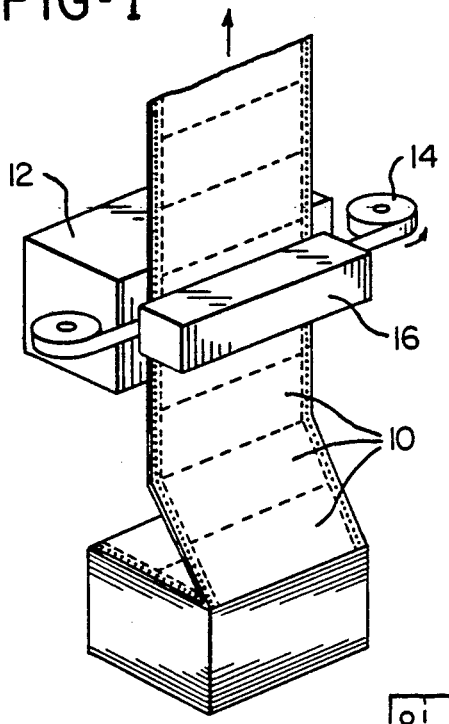
FIG. 1 is a schematic perspective view of an automated printing device for imprinting information onto a continuous web of postal cards constructed in accordance with the present invention.

The postal card or mailer construction 10 of the present invention is illustrated in FIG. 1 in the form of a continuous web which is designed to be printed by automated equipment such as a computer-driven impact printer 12 having a ribbon 14 and a dot matrix or daisy wheel print head 16. As will be explained in greater detail below, in certain embodiments of the invention, ribbon 14 may be unnecessary because of the self-imaging nature of the invention. While the invention is illustrated in this manner, it will be apparent that single postal card constructions may have information imprinted onto them by manual devices such as a typewriter or may even be imprinted by means of a pen or stylus.

Figure 2:
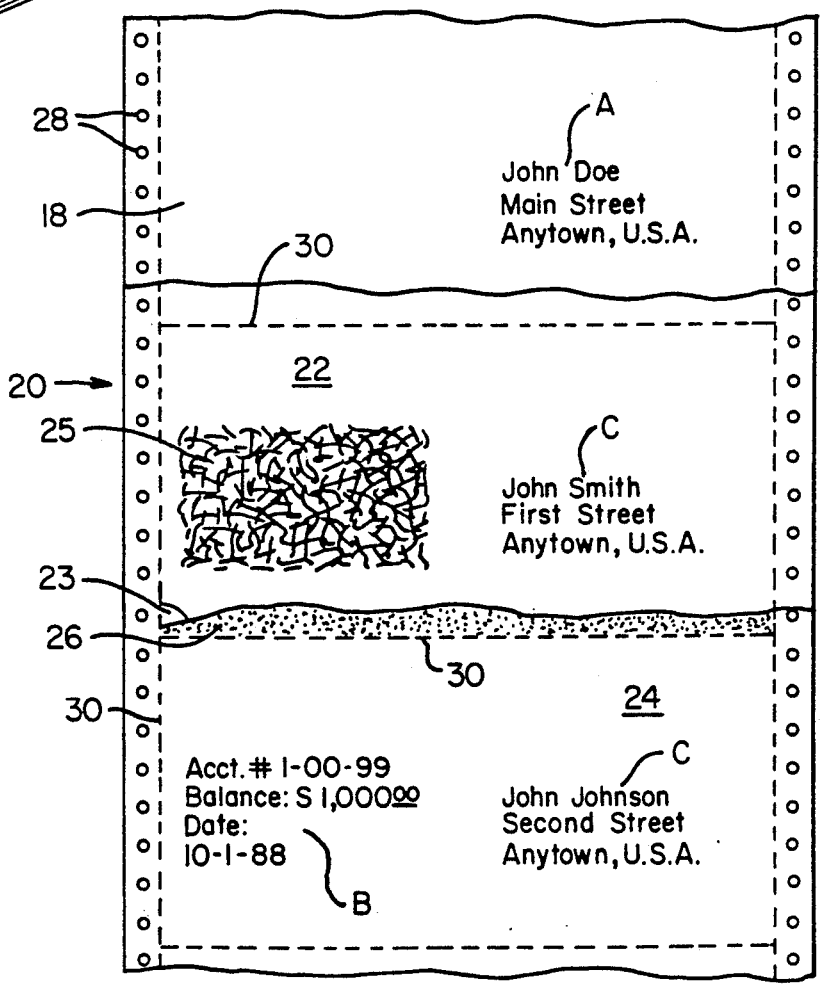
FIG. 2 is a front elevational view, partially in section, of the continuous form postal card or mailer construction of the present invention.
Figure 3:
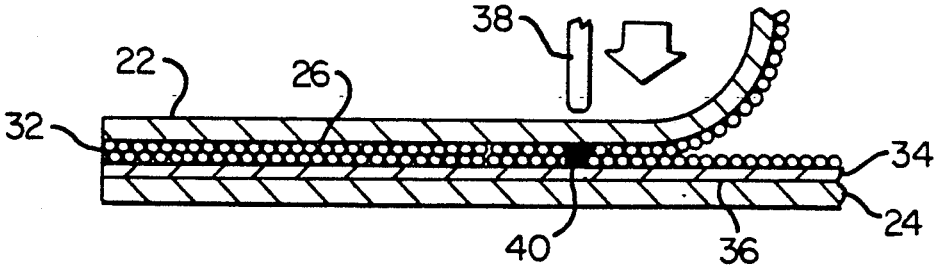
FIG. 3 is a fragmentary sectional view of one embodiment of the postal card or mailer construction of the present invention.

In a preferred form, as illustrated in FIG. 2, the continuous form for producing the postal card or mailer constructions includes one or more single ply webs 18 which are collated together with a composite web 20. In most instances, a single web 18 is sufficient to provide a permanent business record of the information A which is printed. As desired, the permanent information A contained on web 18 may also optionally include confidential information B when ribbon 14 is inked. However, it is not necessary to do so, and the construction may be such that confidential information B is not printed onto web 18. This may be accomplished, as explained in greater detail below, by using no ribbon or a non-inked ribbon and spot coating web 18 with a self-contained carbonless area only where address information is to be printed.

It may be desirable in certain instances to include additional webs 18 to provide multiple copies of the information. Such webs may be coated using carbonless imaging techniques or, alternatively, carbon sheets may be interleaved between the webs so that the impact from print head 16 on the top web will create images on the additional layers.

Composite web 20 includes a cover sheet 22 secured to a base sheet 24 by a releasable adhesive 26. As shown, the collated plies are provided with feed holes 28 in the margins thereof for operation in conjunction with a tractor feed mechanism (not shown) controlled by printer 12. Perforations 30 are also provided along the edges and across the webs so that individual post cards may be separated after the printing operation is completed. While the continuous web is illustrated as being the width of a single post card or mailer, it will be apparent that continuous webs of a width sufficient to provide two or more post cards or mailers side by side are within the scope of the invention.

Cover sheet 22 and/or base sheet 24 are initially in the form of continuous rolls or webs and may be preprinted using any suitable printing techniques with desired repetitive information such as the name of the bank or other sender of the information, a standard greeting, instructions to the addressee, or other information. Each web may be coated with the necessary carbonless imaging chemicals and then secured together using a releasable adhesive.

A suitable releasable adhesive material for use in the invention may be any adhesive which has a low cohesive strength, bonds well to paper or plastic, and is nontacky to the touch when dry. The adhesive may be applied to a surface in a fluid state and then converted to a solid by heat, cooling, radiation, or a chemical reaction. Suitable classes of releasable adhesives include water based, hot melt, solvent based, and so-called 100% solids adhesives. Preferred adhesives are water-based polymer latexes or hot melts such as waxes or polymeric resins.

An especially preferred class of adhesives may be chosen from blends of polyvinyl acetate and polyethylene emulsions. Such blends are formulated by varying the ratio of these two emulsions. Such adhesives are commercially available. The peel strength of these blends may be varied by varying the ratios of polyvinyl acetate to polyethylene.

Suitable physical properties for such a releasable adhesive are: a viscosity of from 3500 to 4500 centipoise at 30 degrees centigrade; a specific gravity of 0.98 to 1.15 grams per cubic centimeter; an oven dry solids content of 43% to 57%; and a pH from 4.5 to 8.5. The adhesive is preferably applied at a rate of from about 3.0 to about 22.0 grams per square meter, and most preferably about 3.0 to about 12.0 grams per square meter, based on dry weight.

The releasable adhesive provides a uniform nonfiber tearing clean release from paper or plastic. Preferred release levels may be in the range of from about 100 to about 500 grams per five centimeters of width, although somewhat higher and lower values are operational. The release test is conducted at 90 degree peel at 1500 centimeters per minute by delaminating the face material from the backing sheet. A releasable adhesive suitable for use in the present invention may generally be identified as one in which cohesive failure occurs as the face sheet is peeled from the backing sheet. Cohesive failure is defined as that which occurs within the layer of adhesive. Adhesive failure is also acceptable. Adhesive failure is defined as failure at the interface between the adhesive and one of the surfaces it contacts.

The adhesive may be applied over substantially the entire area of the webs, may be confined to the peripheral edges only, or may be applied in any desired configuration which will ensure that the two webs will not delaminate prematurely. For example, the releasable adhesive may be applied in strips across the surfaces of the webs. Any feed holes and perforations may also be punched or cut at this time. Additionally, for ease of removal of the cover sheet by the recipient, one or more edges or corners 23 may be die cut or removed from either the cover sheet or the base sheet. Alternatively, one or more corners or edges of the laminate may be left free of adhesive to provide a clean lifting edge for delamination by the recipient.

Both the cover sheet and base sheet are typically of a paper or paper-like material. However, other materials such as a thin plastic sheet may be used. The only requirements are that the material be substantially opaque or modified to be substantially opaque, printable, and that the cover sheet be sufficiently flexible so that when its surface is subjected to an imaging force, the information is transferred to the base sheet. Suitable basis weights for the cover sheet material are in the range of between about 10 to about 50 lb. per ream ($17\times22\times500$ ream), and preferably between about 15 to about 36 lb. per ream. Suitable basis weights for the base sheet material are in the range of about 12 to about 50 lb. per ream, and preferably about 20 to about 40 lb. per ream.

To insure that confidential information printed on the base sheet remains hidden from view, the material used for the cover sheet and the base sheet should be opaque. To assist in insuring opacity of the construction, blockout or camouflage images 25 may be preprinted on the upper or lower surface of the cover sheet or on the lower surface of the base sheet. Alternatively, either or both of the cover sheet and the base sheet may be made to have a high degree of opacity by having been coated with highly pigmented materials, by vacuum deposition of metals, or by any other suitable opacifying treatment. Preferably, these steps are carried out prior to lamination of the two webs as described above.

In one embodiment of the invention where only a single ply is collated with the composite web, the lower surface of web 18 which is positioned adjacent the upper surface of cover sheet 22 in composite web 20 is coated with a color former composition. Such coating may extend over substantially the entire surface of the web, or may be confined to a small area corresponding to the area on cover sheet 22 where address information C is to be printed.

The upper surface of cover sheet 22 is coated with a color developer solution in an area which is to contain imprinted information which is to be visible to the public such as address information C. Upon the impact from an imaging force such as print head 16 onto the upper surface of web 18, the color developer and color former compositions combine to form a distinct color image C of the address information.

In an alternative embodiment of the invention, the lower surface of web 18 contains a means for transferring impression such as a printed carbon imaging spot or a carbon tissue. Upon the impact from an imaging force, the carbon transfers to the upper surface of cover sheet 22 to form the address information C. Again, the impression transfer means may extend over substantially the entire lower surface of web 18, or may be confined to a small area corresponding to the area on cover sheet 22 which is to contain the address information C.

In another alternative embodiment of the invention, composite web 20 may contain a base sheet 24 having on its first surface thereof a layer of colored dye particles, a cover sheet 22 overlying the base sheet, and a releasable adhesive securing the first surface of the cover sheet to the first surface of the base sheet. The releasable adhesive contains a plurality of solvent-containing microcapsules. Upon the impact of an imaging force onto the upper surface of web 18, the microcapsules rupture, release solvent, and dissolve the colored dye particles beneath to form a distinctive color image.

In yet another alternative embodiment of the invention, composite web 20 may comprise a base sheet 24 and a cover sheet 22 overlying the base sheet, and a releasable adhesive including a blend of the solvent-containing microcapsules and the colored dye particles. Upon the impact of an imaging force onto the upper surface of web 18, the microcapsules rupture, release solvent, and dissolve the colored dye particles to form a distinctive color image.

In yet another embodiment, single ply web 18 may be provided with a die-cut window in the area where address information is to be printed. No imaging coatings are required on the lower surface of web 18 or on the upper surface of cover sheet 22. The imprinting device using an inked ribbon Will produce address information directly onto the upper surface of cover sheet 22.

The ability of the present invention to provide a postal card or mailer having hidden information printed thereon is brought about by the proper positioning of two colorless reactants, namely color former and color developer compositions, within the construction. These two reactants, when combined, react to form a colored composition in the area between the cover sheet and base sheet portions of the construction. This may be accomplished in a number of ways, described in further detail below, all of which are within the scope of the invention. The colorless reactants utilized in the practice of the present invention are also found in conventional carbonless copy products. Preferably, one or both of the reactant compositions are encapsulated to isolate the reactants from each other.

Referring now to FIGS. 3–8, various embodiments of the postal card or mailer laminate construction of the present invention are illustrated. While reference is made to the preparation of a continuous web of material, it will be apparent that the procedures disclosed can be used in the manufacture of individual postal card or mailer sheets. The postal card or mailer construction shown in FIG. 3 may be produced as follows. A first color former composition is dissolved in a suitable solvent and the solution is encapsulated as is known in the art, preferably with water as the continuous phase. The first color forming composition may be any of the several known color formers such as leuco dyes and the like. The capsule slurry may be used as produced with the water phase, or all or a part of the water may be removed.

The microcapsules of the first color former composition 32 are blended into the releasable adhesive 26. For example, a water-based releasable adhesive such as a blend of emulsions of polyvinyl acetate and polyethylene may be used. If a hot melt adhesive is utilized, the microcapsules must be separated from the water slurry prior to mixing with the adhesive. Typically, such a hot melt adhesive may take the form of a blend of waxes, resins, and plasticizers.

A second color developer composition 34 is then printed or otherwise applied onto the top surface 36 of base sheet 24, which is preferably in the form of a continuous web. Suitable color developer coatings, known in the art as CF coatings, include acid clay, phenolic resin, and zinc salicylate. Alternatively, the base sheet 24 may be purchased commercially with the color developer layer already coated thereon. Such webs or sheets are available commercially from Appleton paper Company or the Mead Corporation.

At a coating station, the releasable adhesive and microcapsule blend is coated onto either the lower surface of cover sheet 22 or the top surface 36 of base sheet 24. The two continuous webs are then brought together such as at the nip between two pressure rolls, causing the adhesive to form a bond between the two webs. The composite laminated web 20 is then heated to dry the adhesive (if a water-based adhesive was used) or cooled (if a hot melt adhesive was used).

The continuous composite web of the laminate may then be passed through a printing station such as a conventional label press where printed indicia may be repetitively printed onto the top of the continuous cover sheet. Alternatively, the individual webs may be preprinted with repetitive information prior to lamination.

The cover sheet and/or the base sheet is then die cut to form a corner or edge portion that is readily peelable. As previously described, a single ply web 18 or additional plies may be collated with composite web 20 at this stage. Feed holes may be punched in the margins and perforations cut across the web so tat the continuous form may be used in an automated printing device.

The continuous form can now be imprinted with the address and hidden information by an impact-type printer. The imaging force, shown schematically as 38, which produces the image on the front of the cover sheet 22 transfers through that sheet and causes microcapsules of color former 32 beneath the cover sheet to rupture. The color former 32 which is released from the microcapsules comes into contact with the color developer layer 34, causing formation of a colored image 40 on the upper surface of base sheet 24. The image formed is identical to the image formed on the top surface of cover sheet 22 and single ply web 18. Images containing hidden information are also formed at this time on the upper surface of base sheet 24. The hidden information is not reproduced on the upper surface of cover sheet 22 because the imaging force is applied to an area which does not contain an impression transfer means on the lower surface of web 18.

Figure 4:
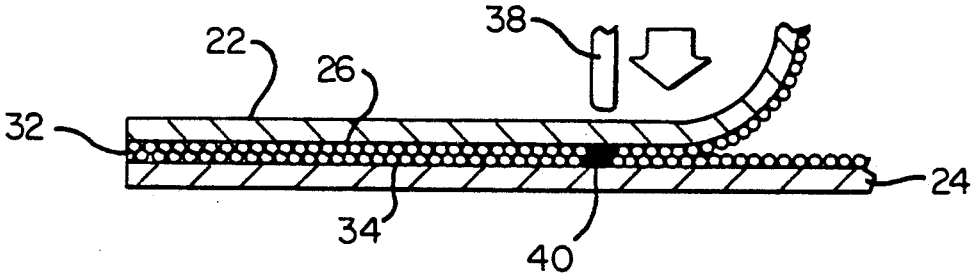
FIG. 4 is a fragmentary sectional view of another embodiment of the postal card or mailer construction of the present invention.

Referring now to FIG. 4, another embodiment of the invention is shown. In this embodiment, the base sheet 24 is not precoated with a color developer composition. Rather, both the color former and color developer compositions are encapsulated and blended with releasable adhesive 26 in the laminate construction. Thus, both microcapsules of color former 32 and microcapsules of color developer 34 are present in the adhesive layer between the cover sheet 22 and base sheet 24.

When imaging force 38 impacts cover sheet 22, the microcapsules beneath are ruptured, the reactants combine, and a colored image 40 forms on the surface of base sheet 24.

Figure 5:
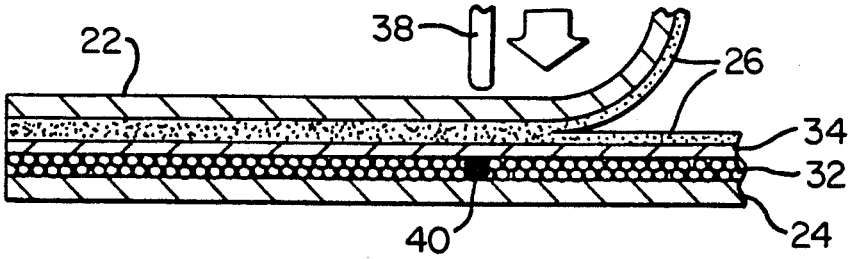
FIG. 5 is a fragmentary sectional view of another embodiment of the postal card or mailer construction of the present invention.

Yet another embodiment of the invention is shown in FIG. 5 which depicts a construction which is simple to manufacture. As can be seen, a so-called self-contained carbonless sheet may be used as the base sheet for this embodiment. Such self-contained sheets are commercially available and include a color developer layer 34 overlying a layer of microencapsulated color former composition 32. Thus, no microcapsules need to be added to releasable adhesive layer 26 prior to lamination of cover sheet 22 with base sheet 24.

Figure 6:
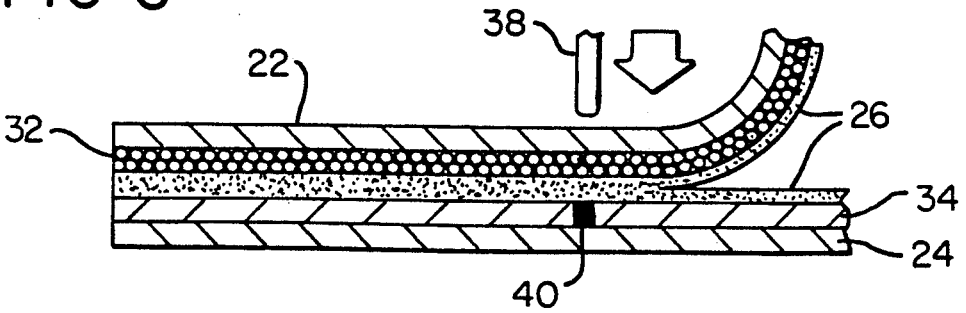
FIG. 6 is a fragmentary sectional view of yet another embodiment of the postal card or mailer construction of the present invention.

Still another embodiment of the invention is shown in FIG. 6. In this embodiment of the invention, cover sheet 22 is a carbonless coated back (CB) sheet containing a color former composition 32 while base sheet 24 is a carbonless coated front (CF) sheet containing a microencapsulated color developer composition 34. Releasable adhesive 26 is designed to be permeable to at least the color former. When the imaging force is applied, the microcapsules rupture, and the exuded liquid color former flows or migrates to the CF surface of base sheet 24 below to form a colored image 40.

Figure 7:
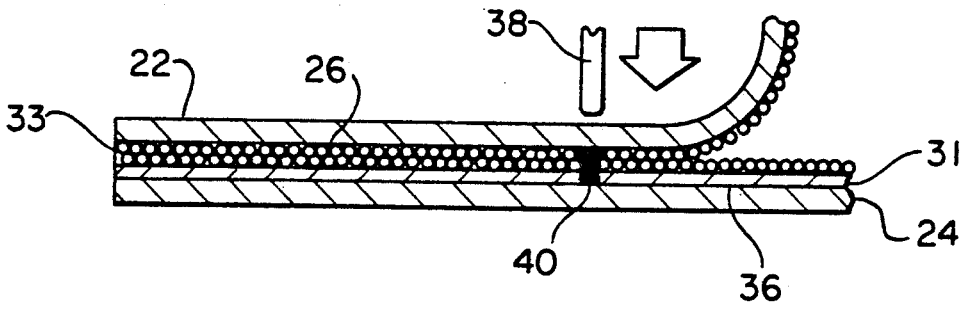
FIG. 7 is a fragmentary sectional view of another embodiment of the postal card or mailer construction of the present invention.

FIG. 7 illustrates another embodiment of the invention in which surface 36 of base sheet 24 is coated with a layer of finely divided particles of colored dye. The dye particles 31 exist as microscopic crystals with low color strength and are contained in the layer at low levels of concentration. Preferably, the amount of dye is less than about 0.03 lb. per 17×22×500 sheet ream. Thus, only slight color is imparted to the coating because the dye is not in a dissolved state. Solvent-containing microcapsules 33 are then blended into the releasable adhesive 26. The releasable adhesive and microcapsule blend is then positioned between the cover sheet 22 and base sheet 24 and secures them together. When imaging force 38 impacts cover sheet 22, the microcapsules are ruptured, and the solvent interacts with the dye layer beneath to form a colored image 40 on the surface of base sheet 24.

Figure 8:
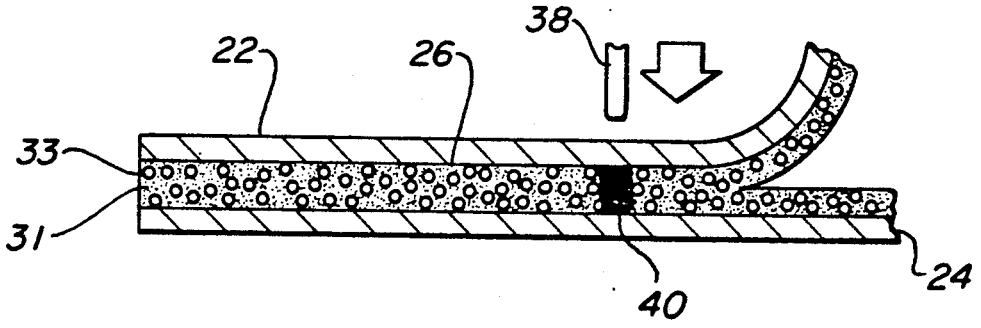
FIG. 8 is a fragmentary sectional view of another embodiment of the postal card or mailer construction of the present invention.

FIG. 8 illustrates a further embodiment of the invention in which both the solvent-containing microcapsules 33 and dye particles 31 are combined and blended into releasable adhesive 26. When imaging force 38 impacts cover sheet 22, the microcapsules are ruptured, the solvent interacts with the dye particles, and a colored image 40 forms on the surface of base sheet 24.

Figure 9:
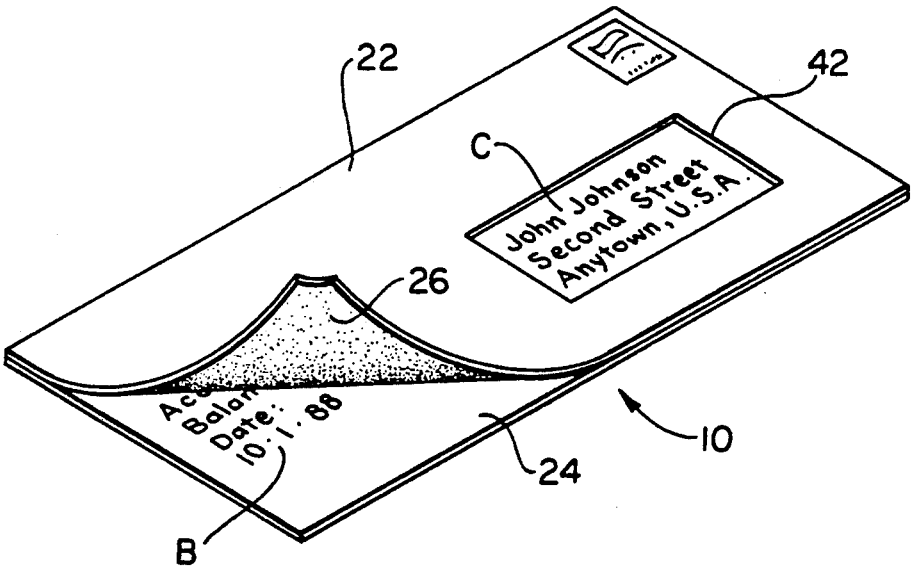
FIG. 9 is a perspective view of a postal card or mailer construction with a cut-out window showing the cover sheet partially peeled back to reveal confidential information printed on the base sheet.

FIG. 9 illustrates another embodiment of the invention in which use is made of a die-cut window 42 in cover sheet 22. The window 42 is positioned over the area where the name and address information on the postal card construction is to be printed. In this embodiment of the invention, base sheet 24 is a self-contained carbonless sheet having both color former and color developer compositions on the upper surface thereof. At least one of the two compositions is encapsulated in a plurality of capsules which burst upon the application of an imaging force.

In the embodiment shown in FIG. 9, the imaging is done with an impact device having no ribbon, or having a blank, non-inked ribbon. All hidden information will be printed on the upper surface of base sheet 24 but will remain hidden under cover sheet 22. The name and address information which is printed will be visible, however, through window 42.

While certain representative embodiments and details have been shown for purposes of illustrating the invention, it will be apparent to those skilled in the art that various changes in the methods and apparatus disclosed herein may be made without departing from the scope of the invention, which is defined in the appended claims.

What is claimed is:

1. A postal card or mailer construction comprising a base sheet, a cover sheet overlying said base sheet, and a releasable adhesive securing a first surface of said cover sheet to a first surface of said base sheet such that said cover sheet and base sheet are readily separable, said releasable adhesive containing therein a first color former composition which, when exposed to a second color developer composition, forms a distinctive color, at least one of said first and second compositions being contained in a plurality of capsules which rupture upon the application of an imaging force on said cover sheet, and said base sheet having on said first surface thereof said second composition.

2. The postal card or mailer construction of claim 1 in which said cover sheet and base sheet are secured at their peripheral edges.

3. The postal card or mailer construction of claim 1 in which a portion of the upper surface of said cover sheet has a camouflage image printed thereon.

4. The postal card or mailer construction of claim 1 in which a corner of said cover sheet or said base sheet has been die cut.

5. The postal card or mailer construction of claim 1 in which a corner of said cover sheet or said base sheet has been removed.

6. A postal card or mailer construction comprising a base sheet having on a first surface thereof a first color former composition and a second color developer composition which, when combined, form a distinctive color, at least one of said first and second compositions being contained in a plurality of capsules which rupture upon the application of an imaging force, a cover sheet overlying said base sheet, and a releasable adhesive securing a first surface of said cover sheet to a first surface of said base sheet such that said cover sheet and base sheet are readily separable.

7. The postal card or mailer construction of claim 6 in which said cover sheet and base sheet are secured at their peripheral edges.

8. The postal card or mailer construction of claim 6 in which a corner of said cover sheet or said base sheet has been die cut.

9. The postal card or mailer construction of claim 6 in which a corner of said cover sheet or said base sheet has been removed.

10. A postal card or mailer construction comprising a base sheet having on a first surface thereof a second color developer composition which, when combined with a first color former composition, forms a distinctive color, said second composition being contained in a plurality of capsules which rupture upon the application of an imaging force, a cover sheet having on a first surface thereof said first color former composition, and a releasable adhesive securing said first surface of said base sheet to said first surface of said cover sheet, said releasable adhesive being permeable to at least said first color former composition such that when an imaging force is applied, said first color former composition migrates to combine with said second color developer composition on said base sheet in the area of said imaging force.

11. The postal card or mailer construction of claim 10 in which said cover sheet and base sheet are secured at their peripheral edges.

12. The postal card or mailer construction of claim 10 in which a corner of said cover sheet or said base sheet has been die cut.

13. The postal card or mailer construction of claim 10 in which a corner of said cover sheet or said base sheet has been removed.

14. A postal card or mailer construction comprising a base sheet having on a first surface thereof a first color former composition and a second color developer composition which, when combined form a distinctive color, at least one of said first and second compositions being contained in a plurality of capsules which rupture upon the application of an imaging force, a cover sheet overlying said base sheet, and a releasable adhesive positioned between said cover sheet and said base sheet.

15. A postal card or mailer construction comprising a base sheet, a cover sheet overlying said base sheet, and a releasable adhesive securing a first surface of said cover sheet to a first surface of said base sheet such that said cover sheet and base sheet are readily separable, said releasable adhesive containing therein a plurality of capsules containing solvent which, when ruptured and combined with colored dye particles, form a distinctive color, said capsules being ruptured upon the application of an imaging force on said cover sheet, and said base sheet having colored dye particles on said first surface thereof.

16. The postal card or mailer construction of claim 15 in which said cover sheet and said base sheet are secured at their peripheral edges.

17. The postal card or mailer construction of claim 15 in which a corner of said cover sheet or said base sheet has been die cut.

18. The postal card or mailer construction of claim 15 in which a corner of said cover sheet or said base sheet has been removed.

19. A postal card or mailer construction comprising a base sheet, a cover sheet overlying said base sheet, and a releasable adhesive securing a first surface of said cover sheet to a first surface of said base sheet, said releasable adhesive containing therein a plurality of solvent-containing capsules and colored dye particles, such that when an imaging force is applied on said cover sheet, said solvent-containing capsules rupture and react with said dye particles to form a distinctive color in the area of said imaging force.

20. The postal card or mailer construction of claim 19 in which said cover sheet and base sheet are secured at their peripheral edges.

21. The postal card or mailer construction of claim 19 in which a corner of said cover sheet of said base sheet has been die cut.

22. The postal card or mailer construction of claim 19 in which a corner of said cover sheet or said base sheet has been removed.

23. The continuous form of claim 19 in which said impression transfer means is a carbon imaging spot.

24. The continuous form of claim 19 in which said impression transfer means is a carbon tissue.

25. A continuous form for producing a series of postal card or mailer constructions comprising a single ply web and a composite web, said single ply web including on the lower surface thereof a first color former composition, said composite ply web including a base sheet, a cover sheet overlying said base sheet, and a releasable adhesive securing a first surface of said cover sheet to a first surface of said base sheet such that said cover sheet and base sheet are readily separable, the opposite surface of said cover sheet adjacent said lower surface of said single ply web containing a first color developer composition in an area of said cover sheet which is to contains imprinted address information, said releasable adhesive containing therein a second color former composition which, when exposed to a second color developer composition, forms a distinctive color, at least one of said second compositions being contained in a plurality of capsules which rupture upon the application of an imaging force on said cover sheet, and said base sheet having on said first surface thereof said second color former composition.

26. The continuous form of claim 25 including a series of perforations across said composite ply web forming individual ones of said postal cards.

27. The continuous form of claim 25 in which said first color former composition on said lower surface of said single ply web is contained in areas corresponding to those portions of said form where address information is to be imprinted.

28. The continuous form of claim 25 in which the upper surface of said single ply web includes an area corresponding to the area where address information is to be printed which is coated with both a first color former and a first color developer composition which, when exposed to each other, form a distinctive color, at least one of said first color former and first color developer compositions being contained in a plurality of capsules which rupture upon the application of an imaging force on said single ply web.

29. A continuous form for producing a series of postal card or mailer constructions comprising a single ply web and a composite web, said single ply web including on the lower surface thereof means for transferring impressions entered onto the upper surface of said single ply web to the upper surface of said composite ply web, said composite ply web including a base sheet, a cover sheet overlying said base sheet, and a releasable adhesive securing a first surface of said cover sheet to a first surface of said base sheet such that said cover sheet and base sheet are readily separable, said releasable adhesive containing therein a first color former composition which, when exposed to a second color developer composition, forms a distinctive color, at least one of said first and second compositions being contained in a plurality of capsules which rupture upon the application of an imaging force on said cover sheet, and said base sheet having on said first surface thereof said second composition.

30. A continuous form for producing a series of postal card or mailer constructions comprising a single ply web and a composite ply web wherein said composite ply web includes a base sheet, a cover sheet overlying said base sheet, and a releasable adhesive securing a first surface of said cover sheet to a first surface of said base sheet such that said cover sheet and base sheet are readily separable, said releasable adhesive containing therein a plurality of capsules containing solvent which, when ruptured and combined with colored dye particles, form a distinctive color, said capsules being ruptured upon the application of an imaging force on said cover sheet, and said base sheet having on said first surface thereof said colored dye particles.

31. A continuous form for producing a series of postal card or mailer constructions comprising a single ply web and a composite ply web wherein said composite ply web includes a base sheet, a cover sheet overlying said base sheet, and a releasable adhesive securing a first surface of said cover sheet to a first surface of said base sheet, said releasable adhesive containing therein a plurality of solvent-containing capsules and colored dye particles, such that when an imaging force is applied, said solvent-containing capsules rupture and interact with said dye particles to form a distinctive color in the area of the imaging force.

32. A postal card or mailer construction comprising a base sheet having on a first surface thereof a first color former composition and a second color developer composition which, when combined, form a distinctive color, at least one of said first and second compositions being contained in a plurality of capsules which rupture upon the application of an imaging force, a cover sheet overlying said base sheet, said cover sheet having a cut out area corresponding to the portion of said base sheet in which addressee information is to be printed, and a releasable adhesive securing a first surface of said cover sheet to a first surface of said base sheet such that said cover sheet and base sheet are readily separable.

* * * * *